US008091989B2

(12) United States Patent
Desse

(10) Patent No.: US 8,091,989 B2
(45) Date of Patent: Jan. 10, 2012

(54) INKJET PRINT DEVICE WITH AIR INJECTOR, ASSOCIATED AIR INJECTOR AND WIDE FORMAT PRINT HEAD

(75) Inventor: Jean-Francois Desse, Guilherand-Granges (FR)

(73) Assignee: Markem Imaje, Bourg les Valence (FR)

( * ) Notice: Subject to any disclaimer, the term of this patent is extended or adjusted under 35 U.S.C. 154(b) by 310 days.

(21) Appl. No.: 12/530,513

(22) PCT Filed: Mar. 13, 2008

(86) PCT No.: PCT/EP2008/052980

§ 371 (c)(1), (2), (4) Date: Sep. 9, 2009

(87) PCT Pub. No.: WO2008/110591

PCT Pub. Date: Sep. 18, 2008

(65) Prior Publication Data

US 2010/0103227 A1 Apr. 29, 2010

(30) Foreign Application Priority Data

Mar. 14, 2007 (FR) ..... 07 53822

(51) Int. Cl.
*B41J 2/07* (2006.01)

(52) U.S. Cl. ..... 347/74

(58) Field of Classification Search ..... 347/74, 347/73, 82, 83

See application file for complete search history.

(56) References Cited

U.S. PATENT DOCUMENTS

| | | | | |
|---|---|---|---|---|
| 3,956,756 | A | 5/1976 | Paton | |
| 3,972,051 | A | 7/1976 | Lundquist et al. | |
| 4,097,872 | A | 6/1978 | Giordano et al. | |
| 4,520,366 | A * | 5/1985 | Cragin, Jr. | 347/74 |
| 4,591,869 | A * | 5/1986 | Katerberg et al. | 347/74 |
| 4,841,306 | A | 6/1989 | Archer et al. | |
| 5,473,353 | A | 12/1995 | Soucemarianadin et al. | |
| 6,554,389 | B1 | 4/2003 | Hawkins et al. | |
| 6,890,053 | B2 | 5/2005 | Myhill et al. | |
| 2004/0263585 | A1 * | 12/2004 | Jeanmaire | 347/74 |
| 2005/0151801 | A1 | 7/2005 | Neese et al. | |
| 2005/0190242 | A1 | 9/2005 | Steiner | |
| 2006/0001722 | A1 | 1/2006 | Stelter et al. | |
| 2006/0197810 | A1 * | 9/2006 | Anagnostopoulos et al. | 347/74 |
| 2006/0232644 | A1 | 10/2006 | Graveson et al. | |

FOREIGN PATENT DOCUMENTS

| | | | |
|---|---|---|---|
| EP | 0 025 493 | A1 | 3/1981 |
| EP | 0 026 836 | A1 | 4/1981 |
| EP | 0 532 406 | A1 | 3/1993 |
| EP | 0 571 804 | A2 | 12/1993 |
| FR | 2 681 010 | A1 | 3/1993 |
| WO | 82/04314 | A1 | 12/1982 |
| WO | 98/36910 | A1 | 8/1998 |

OTHER PUBLICATIONS

International Search Report for PCT/EP2008/052980, dated Jun. 2008.

French Search Report dated Nov. 13, 2007.

Zable; "Splatter During Ink Jet Printing", the IBM Journal of Research Development, Jul. 1977 pp. 315-320.

Lee; "Boundary Layer Around a Liquid Jet", the IBM Journal of Research Development, Jan. 1977 pp. 48-51.

* cited by examiner

*Primary Examiner* — Kristal Feggins

(74) *Attorney, Agent, or Firm* — Pearne & Gordon LLP

(57) ABSTRACT

The invention relates to a wide format print head composed of X inkjet print devices intended to print on a moving support and for which the print quality is to be improved over the entire width.

The solution according to the invention consists of inputting a single air flow passing through the internal cavity of the print head.

21 Claims, 12 Drawing Sheets

INKJET PRINT DEVICE WITH AIR INJECTOR, ASSOCIATED AIR INJECTOR AND WIDE FORMAT PRINT HEAD

TECHNICAL FIELD

The invention relates to an improvement in the print quality of inkjet printers, particularly so-called wide format printers.

More particularly, it deals with several problems encountered in using a large number of jets in a print head.

PRIOR ART

Industrial inkjet printers can be used to print character strings, logos or more highly sophisticated graphic patterns on products being manufactured or on packaging, starting from variable digital data frequently under difficult environmental conditions.

There are two main technological families of printers of this type; one is composed of "drop on demand" printers and the other of "continuous jet" printers.

In all cases, at a given moment, the print head projects a combination of drops aligned on a segment of the surface to be printed in a very short time. A new combination of drops is projected after relative displacement of the head with respect to the support, in the direction usually perpendicular to the segments addressed by the head nozzles. Repetition of this process with variable combinations of drops in the segment and regular relative displacements of the head with respect to the product, lead to printing of patterns with a height equal to the height of the segment and a length that is not limited by the print process.

"Drop on demand" printers directly and specifically generate the drops necessary to make up segments of the printed pattern. The print head for this type of printer comprises a plurality of ink ejection nozzles usually aligned along an axis. A usually piezoelectric actuator, or possibly a thermal actuator generates a pressure pulse in the ink on the upstream side of the nozzle, locally causing an ink drop to be expelled by the nozzle concerned, to determine whether or not a drop is ejected depending on the required combination at a given moment, for each nozzle independently.

Continuous jet printers operate by the electrically conducting ink being kept under pressure escaping from a calibrated nozzle thus forming an inkjet. The inkjet is broken down into regular time intervals under the action of a periodic stimulation device, at a precise location of the jet. This forced fragmentation of the inkjet is usually induced at a so-called jet "break" point by periodic vibrations of a piezoelectric crystal, located in the ink on the input side of the nozzle. Starting from the break point, the continuous jet is transformed into a stream of identical ink drops at a uniform spacing. A first group of electrodes called "charge electrodes" is placed close to the break point, the function of which is to selectively transfer a predetermined quantity of electric charge to each drop in the stream of drops. All drops in the jet then pass through a second group of electrodes called "deflection electrodes"; these electrodes, to which very high voltages of the order of several thousand volts are applied, generate an electric field that will modify the trajectory of the charged drops.

In a first variant of continuous jet printers called "deviated continuous jet" printers, a single jet is capable of successively projecting drops towards the different possible impact points of a segment on the product to be printed. In this first variant, the charge quantity transferred to the jet drops is variable and each drop is deflected with an amplitude proportional to the electric charge that it received. The segment is scanned to successively deposit the combination of drops onto a segment much more quickly than the relative displacement of the head with respect to the product to be printed, such that the printed segment appears approximately perpendicular to said displacement. Drops not deflected are recovered in a gutter and are recycled into the ink circuit.

A second variant of continuous jet printers called "binary continuous jet" printers is differentiated from the previous variant mainly by the fact that the trajectories of the ink drops may only have two values: deflected or not deflected. In general, the non-deflected trajectory is intended to project a drop on the product to be printed and the deflected trajectory directs the unprinted drop to a recovery gutter. In this variant, a nozzle addresses a point on the pattern to be printed on the product, and printing of characters or graphic patterns requires the use of a number of nozzles in the head corresponding to the segment height, for a given resolution.

Applications of industrial inkjet printers can be broken down into two main domains. One of these domains relates to coding, marking and customisation (graphic) of printed products over small heights; this involves print heads comprising one or several jets based on the so-called "deviated continuous jet" technology and several tens of jets using the "binary continuous jet" or "drop on demand" technology.

The other application domain relates to printing, mainly graphic, of flat products with large surface areas for which the width may be very variable depending on the applications and may be up to several meters, the length of which is not limited by the printing process itself. For example, this type of application includes printing of monumental posters, truck tarpaulins, strip textiles or floor or wall coverings, and others.

These printers use print heads comprising a large number of nozzles. These nozzles cooperate to project combinations of drops at the ordered instants, each combination addresses a straight segment on the product.

Two configurations of inkjet printers are normally used to print on large areas. The first configuration can be used when the print rate is relatively low. In this case, printing is done by the print head scanning above the product. The head moves transversely with respect to the advance direction of the product that itself is parallel to the segment addressed by nozzles in the head. This is the usual operating mode of an inkjet office automation printer. The product moves forward intermittently in steps with a length equal to the height of the segment addressed by the nozzles in the print head, or a sub-multiple of this height, and stops during transverse displacement of the print head. The productivity of the machine is higher when the height of the segment addressed by the head nozzles is high, but this height does not usually exceed a fraction of the order of $1/10^{th}$ to $1/5^{th}$ of the width of the product. The "drop on demand" technology is preferred for this configuration, due to the low weight of print heads that can be transported more easily and the greater difficulty of making large print heads using this technology, as is essential in the second configuration. Furthermore, the intermittent printing makes it easier to manage a constraint inherent to this technology, which is that the head has to be brought to a maintenance station periodically to clean the nozzles.

The second configuration helps to obtain the maximum productivity by making the product pass forwards continuously at the maximum printing speed of the head. In this case, the print head is fixed and its width is the same order as the width of the product. The segment addressed by the nozzles in the print head is perpendicular to the direction of advance of the product and the height is equal to at least the width of the product. In this configuration, the product advances continuously during printing as with existing photogravure printing or silk screen printing techniques using rotary frames but with the advantage of digital printing that does not require the production of expensive tools specific to the pattern to be printed.

The development of wide format inkjet printers, typically wider than 1 meter and particularly between 1 meter and 2 meters wide, assumes that it is possible to integrate a large number of nozzles into a single print head. This large number is of the order of 100 to 200 for the "deviated continuous jet" technology and several thousands for the "binary continuous jet" and "drop on demand" technologies. The Burlington U.S. Pat. No. 4,841,306 describes a wide format print head using the "binary continuous jet" technology in a single piece for which the nozzle plate in particular consists of a single part. The Imperial Chemical Industries Inc. U.S. Pat. No. 3,956,756 also describes a wide format head using the "deviated continuous jet" technology. Faced with the difficulty of making this type of head, modular architectures have been developed in which the print head is broken down into small modules that can be made and controlled more easily, and that are then assembled on a support beam. As can be seen in patent EP 0 963 296 B1 or patent application US 2006/0232644, this solution is suitable for "drop on demand" printers. However, modules have to be stacked and offset for size reasons, the connection to zones printed by the modules being made by the management of print start times for each module. The "deviated continuous jet" technology is particularly suitable for modular architectures, and this technology enables a space of several millimeters between jets, so that jets and their functional constituents can be placed side by side over large widths. This possibility of putting jets side by side indefinitely can be transferred onto modules of several jets as was used in patent FR 2 681 010 granted to the applicant and entitled "Module d'impression multi-jet et appareil d'impression comportant plusieurs modules" (Multi-jet print module and print device comprising several modules). This patent FR 2 681 010 describes a wide format "deviated continuous" multi-jet print head composed of the assembly of print modules with m jets, typically 8 jets, placed side by side on a support beam, this support also performing functions to supply ink to the modules and to collect ink not used.

In all cases, in this type of industrial application in which the environment is often severe, drops and their trajectories before impact must be protected as much as possible from external disturbances (currents, dust, etc.) for which a random nature prevents quality control of the printing. This is why drops usually travel between the nozzles and the exit from the head in a relatively confined cavity open to the outside mainly through the drop outlet orifice. This orifice is usually a slit, that should be kept as narrow as possible so that protection of the trajectories is as efficient as possible.

The use of wide format inkjet printers creates some problems. The availability of such printers is limited by the need for periodic maintenance, in other words to periodically clean and dry the functional elements located in cavity in the head, the bottom of the head or the nozzle plate. Furthermore, the print quality cannot be controlled optimally regardless of the printed pattern, due to a mutual interaction between jets.

Three Phenomena are Involved:

1) The ink solvent evaporates from the drops during their path. In the confined space of the internal cavity in the head, the concentration of solvent vapour is such that condensation conditions are quickly reached and internal functional elements of the cavity have to be dried periodically. Those skilled in the art have already attempted to prevent condensation either by heating the surfaces on which there is a risk, but at the price of complex and expensive solutions, or by drying these surfaces using an air flow, possibly with hot air, but the efficiency of this operation requires high air velocities, that causes turbulence when projected onto the internal structure of the cavity with a complex shape, that reduces the stability of the drop trajectories and therefore the print quality.

2) Splatter, that is the main cause of the print head getting dirty and making periodic cleaning necessary. This phenomenon, that is described in an article "Splatter during ink jet printing" by J. L. Zable in the IBM Journal of Research, July 1977, is created due to splatter of very small ink droplets generated at the time of the impact of drops on the support to be printed. These droplets have sufficient kinetic energy so that they can be deposited under the print head and droplets can even return into the head against the current of drops. By accumulating on functional elements inside the head, these droplets eventually degrade operation of the print head. ITW's U.S. Pat. No. 6,890,053 proposes a solution to protect a print head from dirt originating from outside by creating a barrier all around the head composed of an air stream blowing outwards. This solution does not deal with the problem of dirt created by the head itself in the protected containment.

3) Inside the internal cavity of the head, the drops entrain air as studied in the "Boundary layer around à liquid jet" article by H. C. Lee published in the IBM Journal of Research, January 1977. This air accompanies drops as far as their destination outside the cavity. The air deficit created in the cavity is compensated by an addition from the outside through the head outlet slit or through other orifices such as the lateral ends of the cavity located on each side of the head. Drops exit from the head in variable numbers and with a variable density depending on the printed pattern, and obstruct the entry of air to rebalance the internal pressure in the cavity. The result is the formation of currents with a highly variable intensity and direction that modify the drop flight time between the nozzles and the support to be printed. It has been observed that the air deficit at the two ends of the head is easily compensated by opening the cavity to free air which creates a specific behaviour of air currents around the edges of the head. In inkjet technologies, the placement precision of drops on the support and therefore the print quality depends very much on the stability and control of the flight time of these drops, therefore, it can be understood that the phenomenon described prevents optimisation of the print quality, regardless of what pattern is being printed at a given instant.

Note that the nature of this phenomenon of air entrainment by drops that induces a modification to the behaviour of the jets at one location of the head depending on the content of print jets at another location of the head, is different from the nature of aerodynamic interactions between drops in the same jet. These interactions are reproducible for identical situations in the same jet, and can be compensated by acting on the usual print commands. Despite being complicated to implement, many solutions for this compensation have been proposed to attenuate the incidence of the aerodynamic influence of one drop on the trajectory of the next drop, the general concept being to cancel the relative velocity between drops and the surrounding air. For example, IBM's patent EP 0 025 493 and Creo Inc.'s patent US 2005/0190242 apply this type of solution that requires air flows for which the velocity must be very high (several meters or tens of meters per second) and perfectly laminar to avoid turbulence that could disturb drop trajectories. These solutions require very high air flows in the framework of a wide format multi-jet head, and sophisticated, expensive and cumbersome means to guarantee a very stable and perfectly laminar air velocity.

The major disadvantages of using wide format inkjet printers according to the state of the art can be summarised as follows:

1) Condensation of ink solvent vapours in the head can cause functional problems if the inside of the head is not dried periodically.

2) Ink splatter due to the impact on the substrate pollute the printed product, the bottom of the head and even the inside of the head, such that the head has to be cleaned periodically to prevent functional problems.

3) The print quality is not controlled due to disturbances to drop trajectories related to air displacement effects in the head during printing.

Furthermore, as mentioned above, the two transverse ends of the head are open, consequently a specific behaviour of air drafts is created at the edges, reducing the print quality at the ends of the head because it is not homogeneous with the remainder of the head.

PRESENTATION OF THE INVENTION

The invention thus mitigates all or some of the disadvantages mentioned above and discloses a print device capable of improving the quality of the wide format print.

Thus, the solution according to the invention consists of adding a unique air flow passing through the internal cavity in the print head.

To achieve this, a first embodiment of the invention relates to a wide format print head composed of X inkjet print devices intended to print on a moving support in which:

each device comprises:

- a body intended to extend along an axis transverse to the direction of motion of the support,
- an ink ejector fixed to the body and adapted to eject ink along an ejection plane parallel to the axis,
- at least one part defining an output orifice through which at least part of the ejected ink passes to print the moving support,
- a cavity delimited at least by the body, the ejector and the part(s) defining the output orifice,
- an air injector adapted to blow air with a flow approximately parallel to the ink ejection plane passing through the cavity, from a zone below the ejector as far as the output orifice;

the devices are in the form of adjacent modules along the same transverse axis each comprising a block of electrodes in which a single injector is common to all modules, the injected air flow being uniform over the width of the head.

According to a second embodiment of the invention, a wide format print head is composed of X inkjet print devices intended to print a moving support in which:

each device comprises

- a body intended to extend along an axis transverse to the direction of motion of the support,
- an ink ejector fixed to the body and adapted to eject ink along an ejection plane parallel to the axis,
- at least one part defining an output orifice through which at least part of the ejected ink passes to print the moving support,
- a cavity delimited by at least the body, the ejector and the part(s) defining the output orifice,
- an air injector adapted to blow air with a flow approximately parallel to the ink ejection plane passing through the cavity, from a zone below the ejector as far as the output orifice;

the print devices are in the form of adjacent modules along the same transverse axis, each module comprising a block of electrodes and an air injector, the injected air flow being uniform over the width of the head.

Thus, the direction of the flow is approximately parallel to the jets to minimise components perpendicular to the jets that could degrade the print quality.

Preferably, air injected into the head is dry to dry internal functional elements and is advantageously clean to prevent pollution of these elements.

The injected air flow is advantageously greater than the volume necessary to renew air in the cavity at least once per second so as to efficiently expel solvent vapours from the ink towards the outside of the head.

The injected air flow is also advantageously greater than the air flow corresponding to the maximum air quantity extracted by the print process per unit time, in the head.

The location at which air is injected into the cavity is advantageously chosen to prevent the jet being disturbed at the exit from the nozzle.

The air velocity at the air injection is preferably less than a value beyond which the generated turbulence would destabilise the trajectory of the drops and degrade the print quality. The velocity profile at the exit from the injector is as uniform as possible, in order to maximise the flow. The air velocity also preferably remains sufficiently low compared with the velocity of the drops to make the behaviour of the jets relatively insensitive to dispersions and variations of the air velocity profile at the air injection.

The velocity of air expelled from each print module through the outlet slit is high enough to push droplets generated by splatter caused by the impact of drops onto the product being printed.

Preferably, the two lateral ends of the cavity are closed to guarantee uniformity of the jet behaviour over the width of a wide format print head.

The print device may be associated with a method to prevent droplets caused by splatter from returning to the bottom of the head or the support to be printed. This method consists of creating an air draft under the print device parallel to the support to be printed and moving along the direction of movement of the support. This air current entrains droplets originating from splatter to an extraction system. This air current is created either by blowing using blowing nozzle(s), or by suction through suction opening(s), or by combined blowing and suction.

Some aspects of the invention, that improves the print quality and the availability of wide format inkjet printers, are applicable to "drop on demand" and "binary continuous jet" printers, but it is particularly suitable for "deviated continuous jet" printers in which all aspects of the invention can be used. Therefore, the invention will be described in the following in the context of this preferred type of printers.

The invention also relates to the arrangement of an air injector in a print module composed of m jets that can be put side by side (in other words ejecting a number equal to m inkjets).

It also relates to a wide format print head using the "deviated continuous jet" technology equipped with air flow generation means and an air flow distribution system, and a plurality of m-jet print modules according to the invention, placed adjacent on a common support beam.

BRIEF DESCRIPTION OF THE DRAWINGS

Other advantages and characteristics of the invention will become clear after reading the detailed description below given with reference to FIGS. 1 to 11 as follows.

Figure 1A:
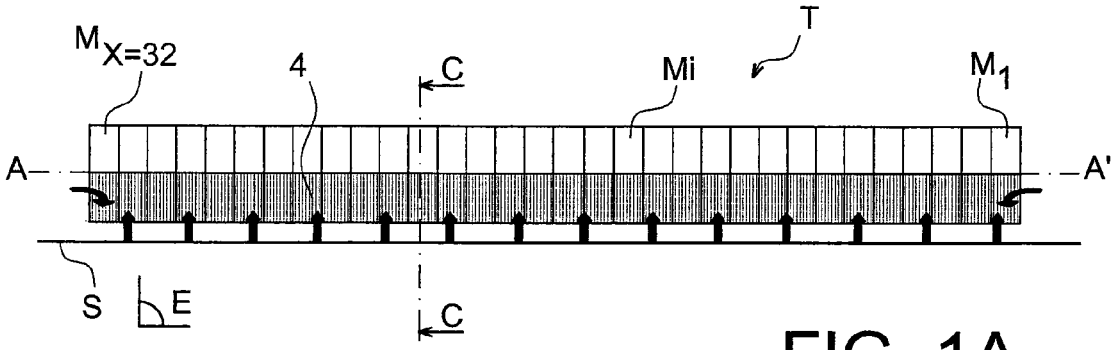
FIG. 1.

1A shows a wide format multi-jet print head (T) according to the state of the art, with the jets in operation but without printing the support (S),

1B is a sectional view along axis C-C in FIG. 1A, showing a multi-jet print module (Mi) integrated into the print head (T) according to the state of the art, and operating according to the preferred "deviated continuous jet" technology.

Figure 2A:
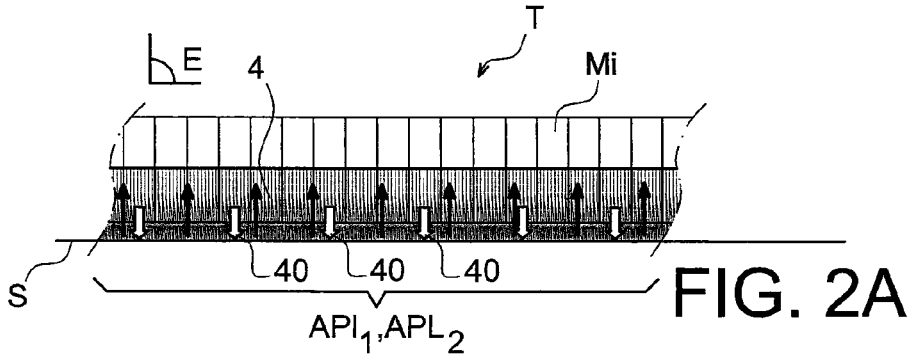
Figure 3A:
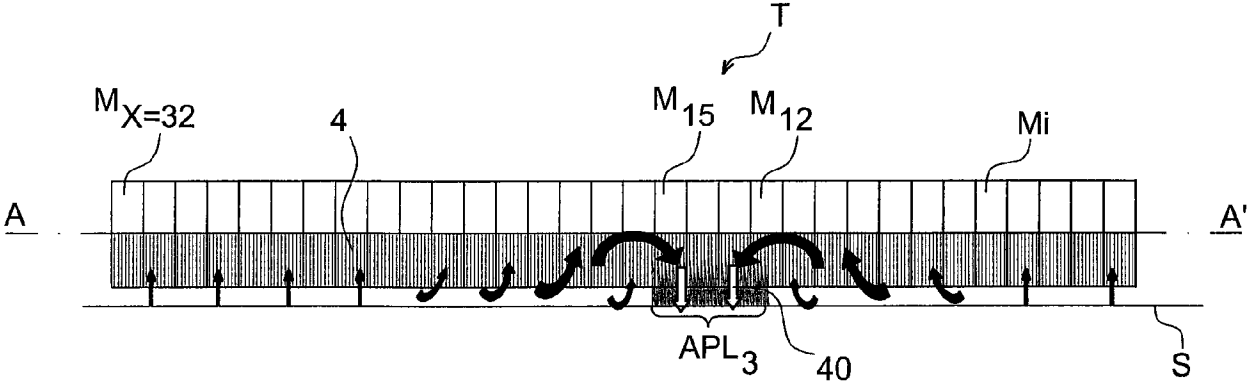
Figure 4:
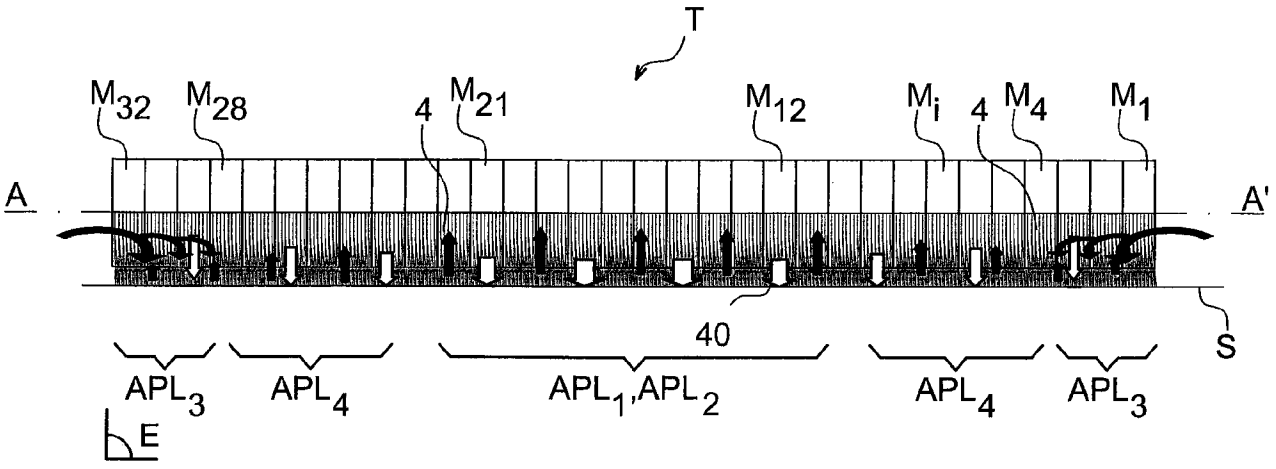

FIG. 2:

2A shows a partial view of the central part of the wide format multi-jet print head according to FIG. 1A, with the jets in operation printing a full tone (APL1, APL2),

2B is a view of a portion of several jets in FIG. 2A, of the result of printing on the support (S) at the beginning of a full tone (APL1) with density equal to 100% (called type A printing),

2C is a view on several jets in FIG. 2A, of the result of printing the support (S), at the beginning of a grey level full tone (APL2) (density <100%), the connection between jets having been made on a 100% full tone (APL1),

FIG. 3:

3A shows a wide format multi-jet print head (T) according to the state of the art, with jets in operation but only some of them printing a full tone (APL3) on a portion of its width and therefore of the support (S),

3B is a view on several jets in FIG. 3A, of the beginning of a 100% full tone (APL3) (called type B printing), FIG. 4 shows a wide format multi-jet print head (T) according to the state of the art, with jets in operation printing a full tone (APL1, APL2-APL3-APL4) over its entire width.

Figure 5:
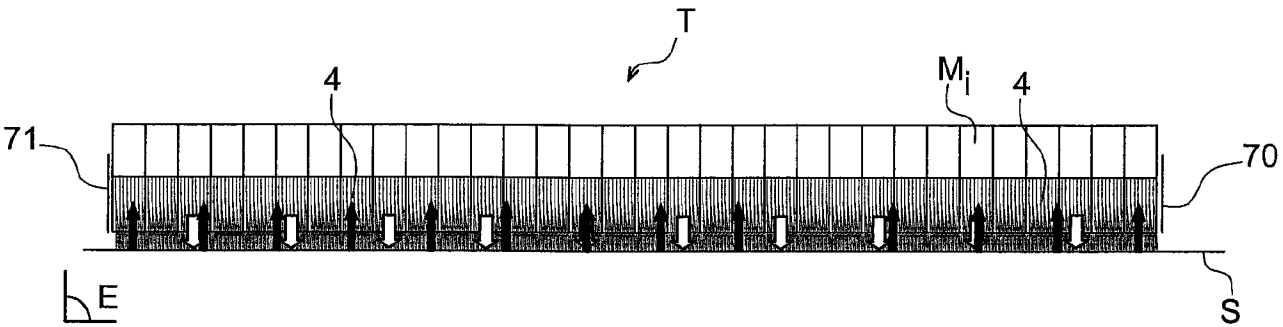

FIG. 5 shows a wide format multi-jet print head (T) with lateral orifices closed by end plates, according to the invention, printing a full tone (APL1, APL2) over its entire width.

Figure 6A:
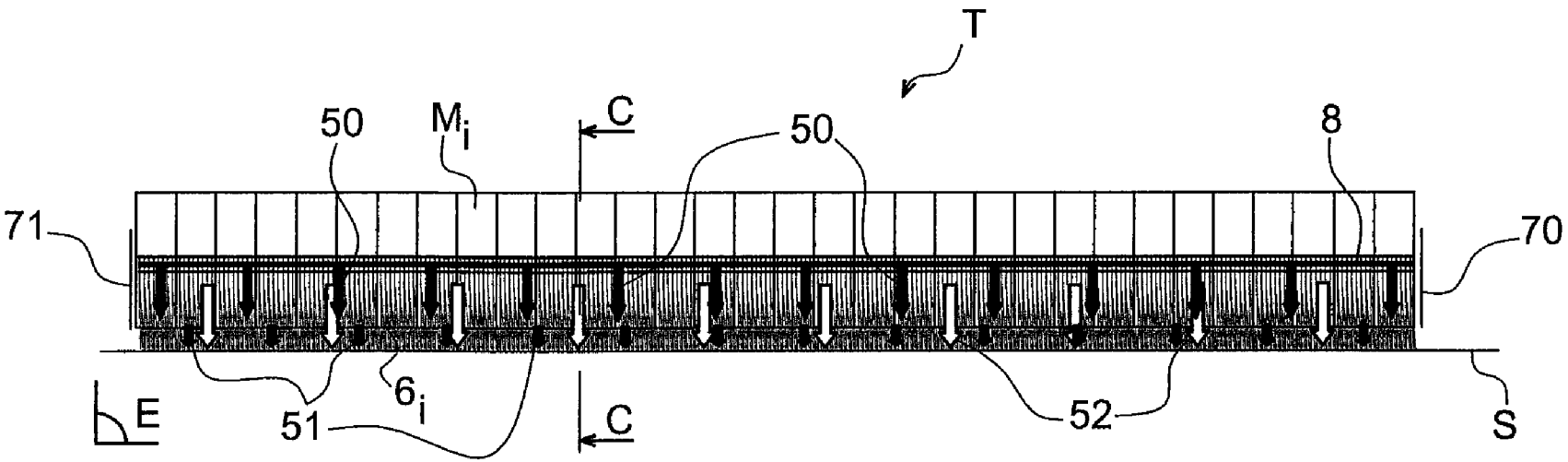

FIG. 6:

6A shows a wide format multi-jet print head (T), equipped with end plates and air injection according to the invention, with jets in operation according to the preferred "deviated continuous jet" technology and printing the support (S) over its entire width,

6B is a sectional view along axis C-C in FIG. 6A, of a multi-jet print module (Mi) integrated into the print head (T) according to the invention, and operating according to the preferred "deviated continuous jet" technology.

FIG. 7:

7A is a sectional view along axis C-C in FIG. 6A, showing the air injector according to one embodiment of the invention,

7B is a perspective view of the air injector according to the invention,

7C is a sectional view along axis C-C in FIG. 6A, showing the air injector according to another embodiment of the invention.

Figure 7A:
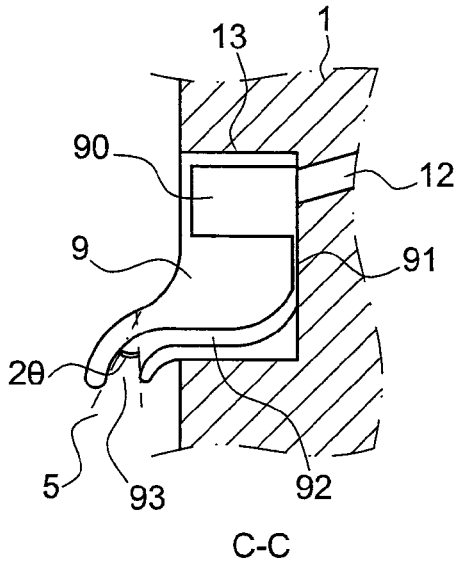
Figure 8A:
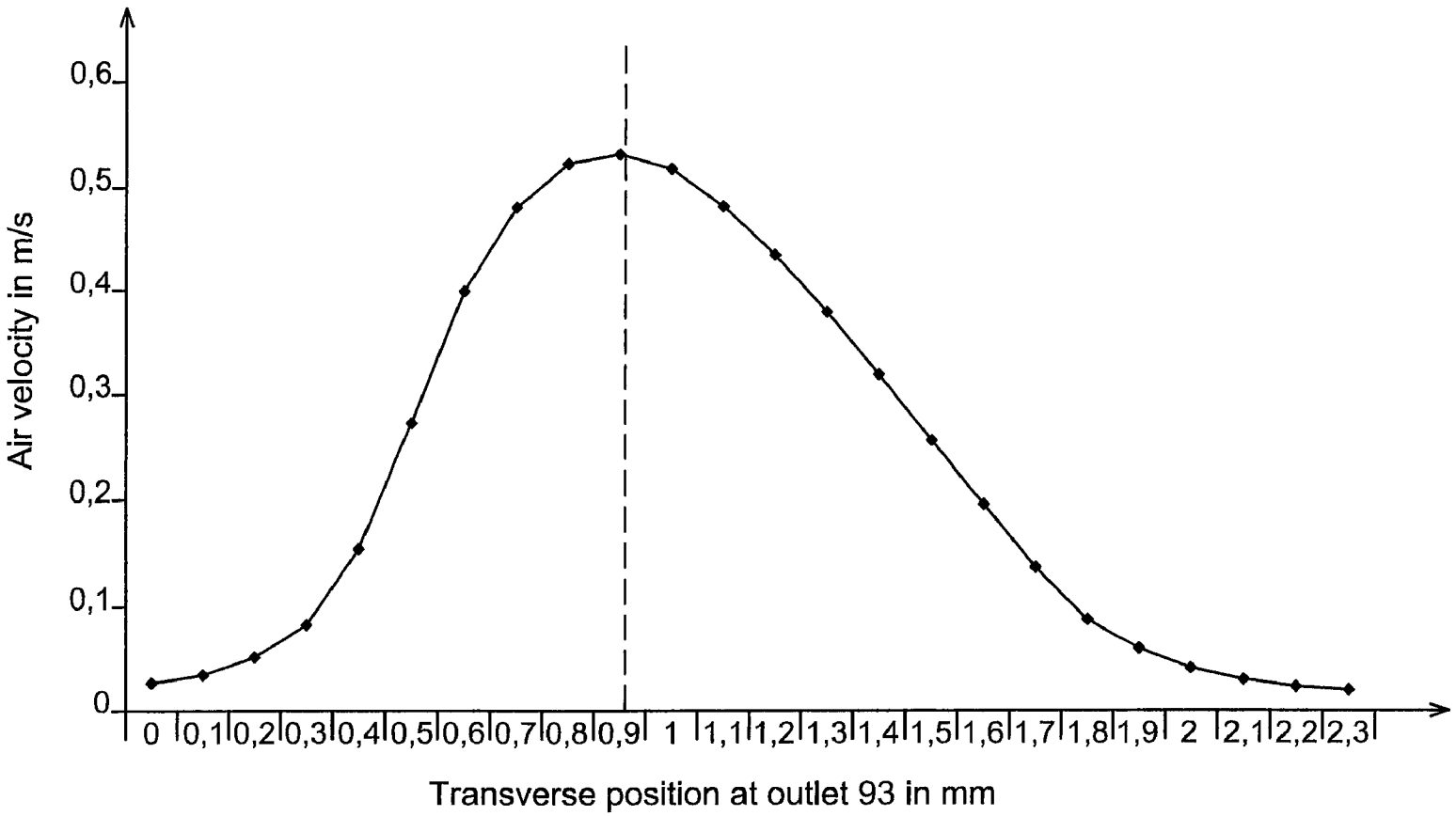

FIG. 8:

8A shows a graphic view of the air velocity profile at the exit from the air injector according to FIGS. 7A et 7B, transverse to its output,

8B shows a graphic view of the air velocity profile at the exit from the air injector according to FIGS. 7A et 7B, longitudinally to its output and close to the maximum in dashed lines shown in FIG. 8A.

Figure 9:
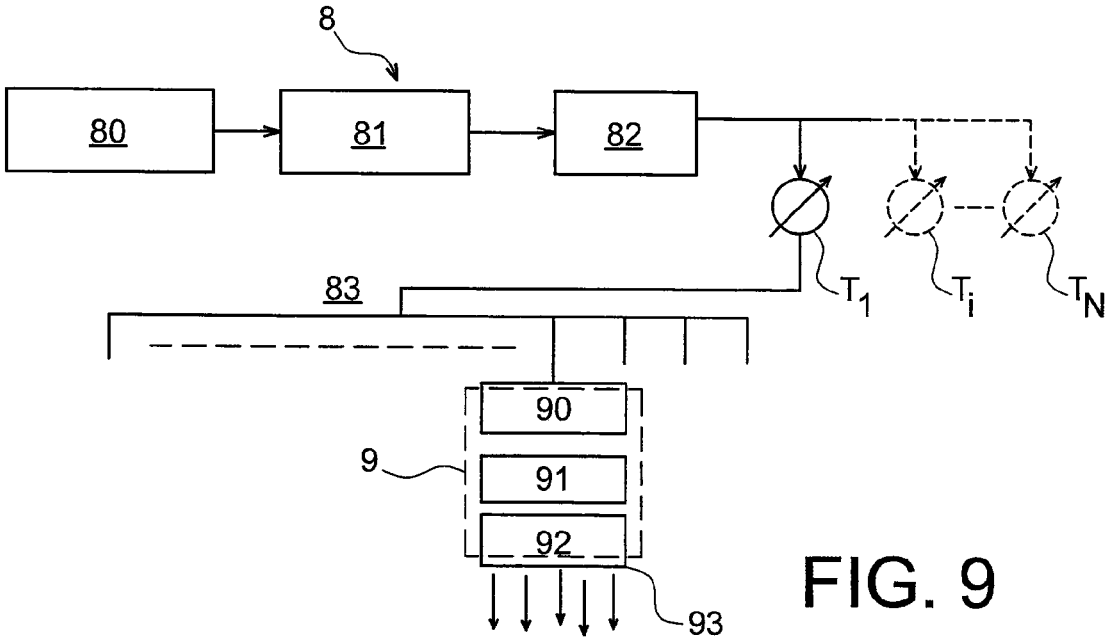

FIG. 9 shows the principle diagram for the supply of air to be injected in a printer comprising several wide format print heads T1, . . . , Tn according to the invention.

Figure 10A:
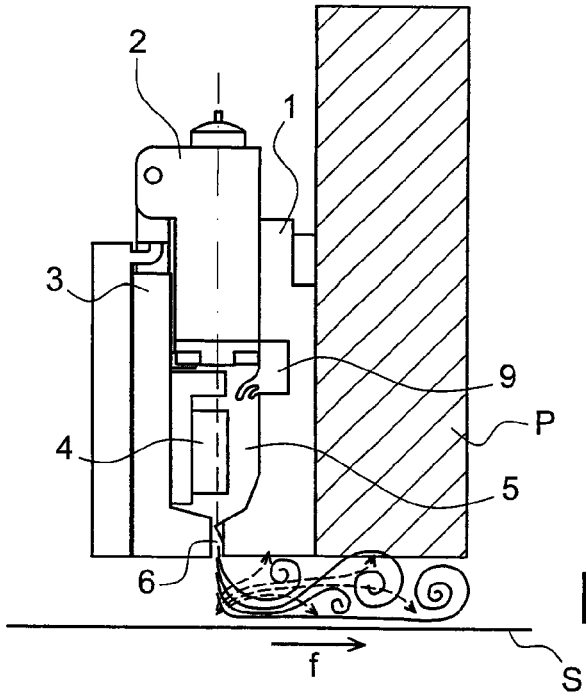
Figure 10B:
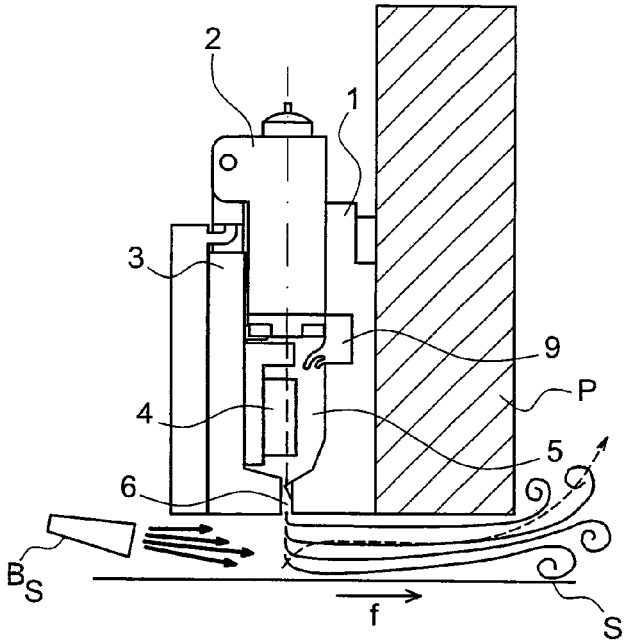
Figure 10C:
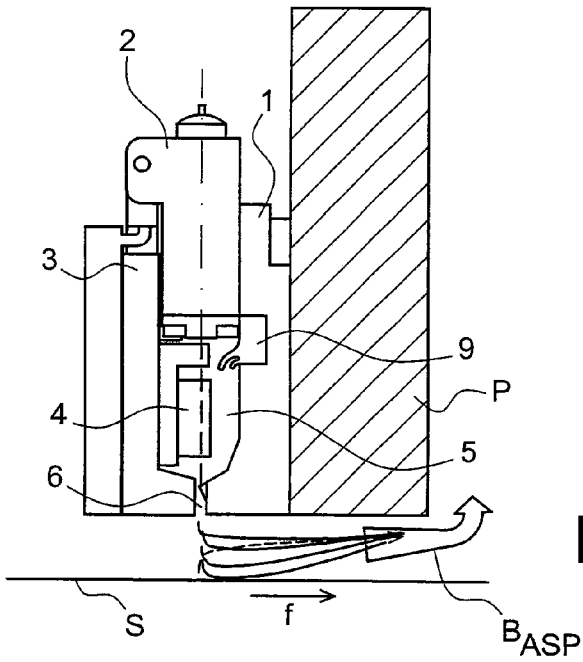

FIG. 10:

10A is a diagrammatic representation of splatter generated by ink droplets that can occur close to the wide format print head (T) according to the invention, between the print head and the support (S) to be printed while the support is moving under the head,

10B is a diagrammatic representation of a complementary means according to the invention enabling blowing of the droplets in FIG. 10A,

10C is a diagrammatic representation of a complementary means according to the invention enabling suction of the droplets in FIG. 10A,

10D is a diagrammatic representation of the combination of the complementary means according to the invention as shown in FIGS. 10B and 10C, enabling both blowing and suction of the droplets in FIG. 10A.

DETAILED PRESENTATION OF PARTICULAR EMBODIMENTS

The preferred technology for producing a wide format inkjet printer is the "deviated continuous jet".

The use of a large number of simultaneous jets in a print head at a constant spacing, addressing connectable print zones on the support to be printed and thus enabling printing over large widths, is described in French patent FR 2 681 010 granted to the applicant and entitled "Module d'impression multi-jet et appareil d'impression comportant plusieurs modules" (Multi-jet print module and print device comprising several modules). In this patent mentioned above, a wide format multi-jet print head (T) is composed of the assembly of X print modules (Mi) each producing m jets, typically 8 jets, and placed side by side on a support beam, which also performs functions to supply ink to the modules and to collect unused ink.

Thus, a wide format print head (T) according to the state of the art is composed identically of X print modules (Mi) and extends along an axis A-A' transverse to the moving support (S) to be printed (FIG. 1A).

Figure 1B:
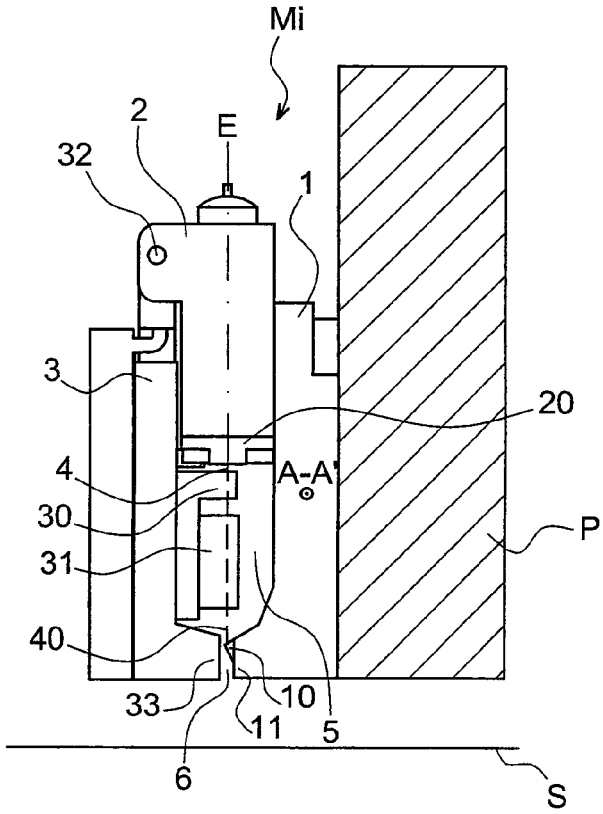

Each print module according to the invention (Mi) is composed firstly of a body 1 supporting an ink ejector 2 with m jets 4 of drops 40 and integrating a set of m recovery gutters 10, and also a block of retractable electrodes 3 supporting two groups of electrodes necessary for the deflection of some drops; a group of charge electrodes 30 and a group of deflection electrodes 31 (FIG. 1B). More precisely, the ink ejector 2 is adapted to eject ink in the form of continuous jets 4, the break point of each jet being placed close to the middle of the charge electrodes 30 of the electrodes block 3. The jets 4 are parallel in a vertical plane (E) and the drops 40 travel from the nozzles of the plate 20 fixed to the ink ejector 2 towards the orifice of the corresponding recovery gutter 10.

The electrodes block 3 can be lowered or raised, by pivoting it about the axis 32. When it is in the extreme down position, in other words in the operating position, the electrodes 30, 31 are inserted in the path of the drops 40 and control the charge and deflection of some drops that escape from the gutter 10 and are deposited on the support to be printed (S).

When in the extreme down position, each electrodes block 3 forms an internal cavity 5 with the body 1 and the ink ejector 2. More precisely, the internal cavity 5 is limited at the back by the body 1, at the front by the electrodes 30, 31, at the top by the nozzle plate 20 and at the bottom by the projection 11 of the body integrating the gutter 10 and the toe 33 of the electrodes block 3. The space between the projection 11 and the toe 33 of the electrodes block 3 defines an output orifice 6 forming a slit through which drops 40 can pass for printing (FIG. 1B). This slit 6 is as narrow as possible to assure confinement of the cavity 5. Such a confinement can protect the drops currently being deflected from external disturbances, such as air currents or ink projections, dust or other, for which the random nature prevents control over the print quality.

When all electrode blocks 3*i* of the head (T) are in their extreme down position, the internal space 5*i* of each module (Mi) forms a single elongated cavity 5 for which the section is approximately identical over the entire width of the head.

The phenomena described above in a general manner exist in this print head according to the state of the art (FIGS. 1A and 1B):

1) The condensation phenomenon mainly affects high voltage deflection electrodes 31 and the insulating parts that support them. These parts are dry so as to guarantee sufficient insulation level between the plates raised to a potential difference of several thousand volts and to prevent any current consumption in the electronic (generating) device creating the high voltage. These conditions guarantee good deflection stability and eliminate risks of the high voltage generator from tripping, which can occur at indeterminate instants and cause a sudden stop of the deflection of the drops.

2) Splashes are generated at the time of the impact of the drops 40 on the support (S). In the "deviated continuous jet" technology, the relatively large size of the drops 40 and their high impact velocity contribute to resending droplets with a high kinetic energy towards the head. They are also disturbed by turbulent air currents present between the head (T) and the moving support (S). Furthermore, these droplets are electrically charged because the printed drops themselves are charged to be deflected. Under these conditions, the droplets can be redeposited on the bottom of the head (T) and on the support (S), but they can also pass through the output slit 6 of the drops in the reverse direction and return to the cavity 5. They are then electrostatically attracted by the deflection electrodes 32 that become dirty, with the same consequences as in the case of condensation.

Figure 2B:
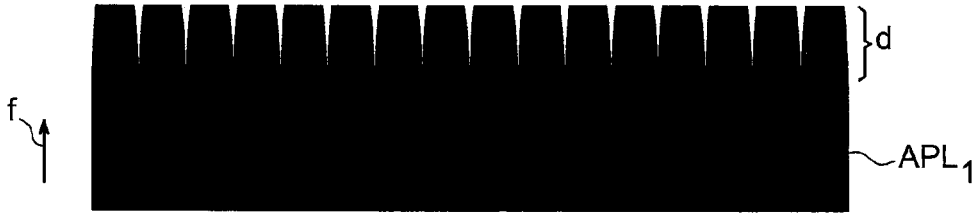

3) During the use of a print head (T) based on the principle of a deviated continuous jet, it is found that the deflection amplitude of drops 40 of jets 4 located at a given location on the head is influenced by the printing of other jets 4*i*, these jets 4*i* possibly being relatively far from the jets 4. These "inter-jet" phenomena are demonstrated by considering the printout of a particular pattern over the width of the head, comprising a sequence of 100% full tones (maximum drop density, all printable positions occupied) and 0% (no printed drops), for all jets 4*i* on the head (T) at the same time. The jets are previously "connected", in other words the electronic adjustments have been applied to the jet deflection control devices such that the printable zone addressed by each jet 4*i* is perfectly adjacent to those of the neighbouring jets (FIG. 2B). This process is described in the patent application FR2801836 entitled "Imprimante fabrication simplifiée et procédé realisation" (Printer with a simplified manufacturing and production process) filed by the applicant. Printing the above pattern shows that at the beginning of a 100% full tone (APL1), the deflection of the jets is smaller than the connection deflection, and it then progressively increases during a certain time until it reaches the nominal connection deflection at the end of a few millimeters (about fifteen) (FIG. 2B).

The other parameters that influence the deflection having been satisfied, it is found that this behaviour is due to a variation in the flight time of the drops.

For all inkjet technologies, this result creates an inaccuracy in the impact time, and therefore the position of the drop 40 on the support to be printed in the direction of motion f of the support.

For the "deviated continuous jet" technology, this also causes a modification in the presence time of charged drops 40 in the field created by the deflection electrodes 31; the deflection increases when the drops slow down and vice versa. When few or no drops 40 are printed, which is the situation present before the start of printing, the drops follow a trajectory one behind the other in the nozzle as far as the recovery gutter 10 (FIG. 1B). Inside the internal cavity 5 of the head (T), the drops 40 entrain air in contact with the jet. This air entrainment phenomenon has been studied by H. C. Lee in the "Boundary layer around a liquid jet" article published in the IBM Journal of Research, January 1977. The drops 40 and the entrained air are sucked in by the gutters 10; the air deficit in the cavity 5 can easily be compensated by an input from the outside of the head (T), mainly through the outlet slit 6 of the drops 40 and lateral openings of the cavity 5. In equilibrium, a fairly low but regular air flow circulates between the outside and the inside of the cavity 5. FIG. 1A illustrates this situation for a head with X=32 identical modules (Mi), schematically shown in section in a vertical plane (E) passing through the middle of the cavity 5 and the outlet slit 6 of drops 40. The cavity 5 is limited at the top by the level of nozzle plates 20*i* and at the bottom by the level of the gutters 10. In this FIG. 1A, the small black arrows distributed under the head (T) diagrammatically show the incoming air flow through the outlet slit 6 of the drops; the size of the arrows being proportional to the intensity of the flow.

The first drops 40 of a 100% full tone (APL1) are emitted outside the head under these aerodynamic conditions in the head, as shown diagrammatically in FIG. 2A. It is known that due to the aerodynamic effect, a drop 40 that penetrates in air creates a positive pressure in front of it and a pressure pressure behind it. If another drop follows it, the other drop is drawn in by the pressure pressure preceding it and its velocity increases. When printing a 100% full tone (APL1) (FIG. 2B), the expected behaviour in free air is that the drops 40 at the beginning of the full tone that deviate from the trajectory carrying them to the gutters 10, penetrate into the air at a given velocity and progressively the velocity of the following drops increases until an equilibrium is found. The consequence should result in a transient behaviour of the deflection of the jets 4 that should reduce between the first front of drops in the full tone and when the equilibrium condition is set up. But as described above, the opposite effect is observed. The inventor has shown that a high pressure pressure is created inside the cavity 5, which counteracts the aerodynamic effects described above. This pressure pressure is generated:

- firstly by the drops 40 output from the head (T) in large quantities (shown diagrammatically by white arrows in FIG. 2A), that entrain a large air volume towards the outside,
- secondly, by suction of the gutters 10 which, having much less ink 4 to be recycled, take up more air.

This pressure pressure can only be compensated by an incoming air flow (shown diagrammatically by the black arrows in FIG. 2A), particularly through the counter current slit 6 of the drops 40. However, the effective (or real) width of the slit 6 through which air can enter is very much reduced by the front of outgoing drops (white arrows figure 2A), which increases the incoming air circulation velocity. These effects slow down the drops 40 which increases their deflection because they stay within the deflection electrodes 31 for a longer period. The time to set up this condition, starting from the beginning of printing a 100% full tone (APL1) 100%, then creation of the pressure pressure until an equilibrium has been set up, is of the order of 2 to 3 seconds, which corresponds to a transient disturbance of the deflection that disturbs printing over about 3 to 4 times the width of a jet 4 as shown in FIG. 2B. This FIG. 2B shows the start of printing a 100% full tone (APL1) over several jets, which after a given set up time (corresponding to a given distance d shown in FIG. 2B), has a correct jet connection; the full tone background (APL1) shown in FIG. 2B is continuous over the entire width. This type of behaviour is called Type A printing.

Figure 2C:
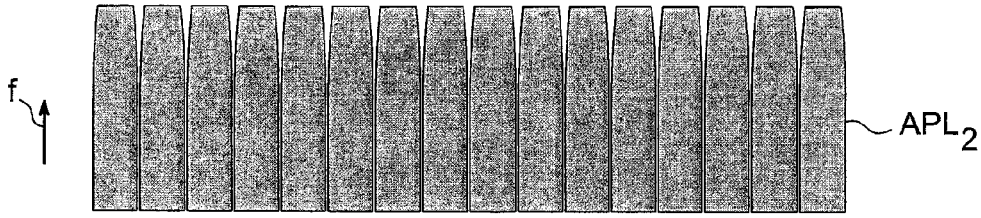

As illustrated in FIG. 2C, the inventor has demonstrated that the amplitude of the effect on the deflection depends on the density of printed drops, in other words the deflection amplitude at the beginning of the full tone does not depend on the density of drops printed in the full tone; but the amplitude reached under steady conditions is correspondingly smaller when the density of printed drops is low. This creates a problem with the stability of the connection of printable zones in each jet. If the connection was optimised over a 100% full tone (APL1), the printable zones will no longer be quite adjacent if a full tone with a lower density (APL2) is printed (FIG. 2C). In the case in which an arbitrary pattern composed of zones with variable drop densities is printed, printing cannot be optimum everywhere at the same time (FIG. 2C).

Figure 3B:
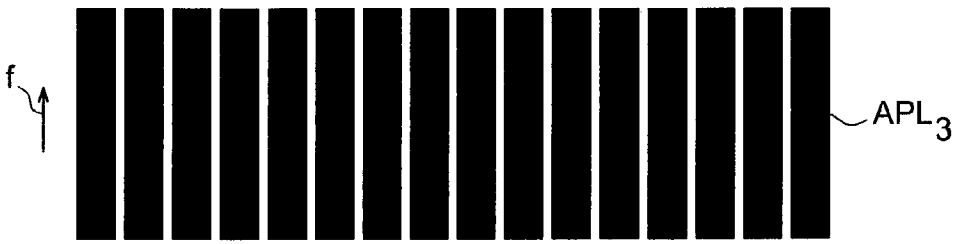

In FIG. 3A, a single portion (M12 to M15) of the head (T) prints a 100% full tone (APL3). It is seen that the deflection variation of jets does not appear and the jet printing zones, previously connected over a 100% full tone (APL1) printed over the entire width of the head, have a constant width but are no longer adjacent (FIG. 3B). This type of behaviour is called type B printing. In this case, the pressure pressure created in the cavity 5 at the portion (M12 to M15) of the head (T) printing the full tone (APL3) is easily compensated by air incoming through the outlet slit 6 in zones in which the density of the printed drops is zero or low. Under these conditions, air circulation does not hinder circulation of the drops 40 in the cavity 5 and through the outlet slit 6; their velocity and therefore their deflection remain unchanged.

In addition to the phenomena 1), 2) and 3) mentioned above, it is found that in the case of a wide format printer (T) according to the state of the art and according to the principle of the deviated continuous inkjet as described in patent FR 2 681 010 mentioned above, the jets 4 located on the extreme lateral edges (M1 and M32) are not affected by the widening of the frame, even when printing a 100% full tone over the entire width of the head (T). This effect attenuates progressively from the edges (M1 and M32) towards the middle of the head (T) over a distance of a few modules. As shown in FIG. 4, printing is of type B towards the edges (firstly M1 to M4 and secondly M28 to M32) of the head (T), type A in the central part (M12 to M21), of the head (T), and intermediate APL4 between the two (firstly M4 to M12 and secondly M21 to M28). The pressure pressure is compensated by external air benefiting from a local access to the cavity 5. The jets 40 concerned benefit from air incoming through the lateral openings of the cavity 5 located on each side of the head (right side of M1 and left side of M32). The black arrows and the curves shown diagrammatically in FIG. 4 illustrate this phenomenon.

The phenomena described imply that the connection valid for large full tones is no longer valid for small patterns, and more generally the jets deflection amplitude depends on the printed pattern near to several tens of centimeters on each side of the jets considered.

During any printing, the two effects illustrated in FIGS. 2A to 4 are all present at the same time and with variable intensities over the width of the head, depending on the nature of the printout at a given instant. This situation means that compromises have to be made to minimise the result that degrades the print quality, depending on the printout, which in any case cannot be perfect.

The solution according to the invention shown in FIGS. 5 to 10D can give a better print quality, independently of the print type.

Firstly, in order to reduce non-homogeneity in the behaviour of the print along the head (T), according to the invention the openings (right side of M1 and left side of M32) of the cavity 5 opening up on each side of the head (T) are closed using the end plates 70, 71 (FIG. 5). The deflection behaviour of the drops then becomes practically identical over the width of the print head as shown in FIG. 5. The printout is then type A everywhere under the head (T) (the white arrows indicating the output front of the drops 40).

FIG. 6A shows the diagram of a print head (T) according to the invention, equipped with closing end plates 70, 71 of the lateral openings (right side of M1, left side of M32) of the cavity 5 and a blower device 8, distributed over the width of the head, which creates an air inlet for which the flow shown by the longest black arrows 50 passes through the cavity 5 from the top towards the bottom and prolongs by an outgoing flow, represented by the shorter black arrows 51 towards the outside of the head (T) through the continuous outlet slit 6 of the drops 40. Air transported by the drops 40 or drawn in by the droplets 10 no longer has any effect on the drop velocity, which behave as if they were moving in free air; this is shown by the white arrows 52 in FIG. 6A longer than the white arrows in FIG. 5. Furthermore, the presence of the end plates 70, 71 homogenises the behaviour over the entire head, which is shown in FIG. 6A, by arrows with equal length over the entire width of the head. Printing of a full tone over the head width is then of type B everywhere under the head. Therefore the connection made on a 100% full tone (APL1) remains valid for grey levels (APL2) and for arbitrary patterns (APL3, APL4).

Figure 6B:
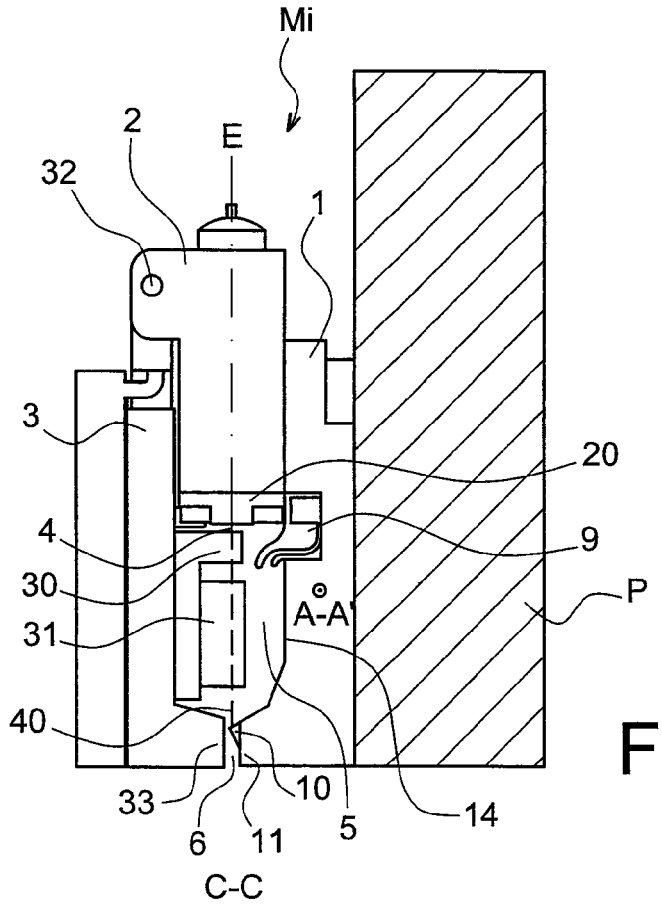

FIG. 6B contains a section along C-C showing a preferred arrangement of the blower device 8 according to the invention at one of the modules (Mi) of a modular "deviated continuous jet" wide format print head. In this case, the blower device 8 comprises an air injector 9 adapted to generate an air flow using the solution described above with reference to FIG. 6A.

Preferred Arrangement of a Blower Device or an Air Injector:

The layout of an air injector 9 according to the invention in each print module (Mi) forming the head (T) is intended such that air is injected into the internal cavity 5 of the head (T), below the charge electrodes 30 but above the deflection electrodes 31 (FIG. 6B). This air injection zone in the cavity 5 prevents moving air from disturbing breaking of jets 4 according to the "continuous jet" technology. In this technology, stability at the time of the break can be used to control the charge of the drops 40 and therefore the print quality by means of the stability of deflection of the drops 40. This injection zone also enables air to reach the zone located between the deflection electrodes 31 so as to dry these electrodes, without sending the flow directly onto the drops 40 in flight. The exit from the injector placed between the jets 4 and the internal wall 14 of the body 1, directs air approximately parallel to the jets 4. These jets are thus only concerned by air circulating at the edge of the air stream output from the injector 9. The air movement at this location is weakened and is parallel to the jets 4. This thus minimises components of the air velocity perpendicular to the jets 4 that, when they exceed a certain threshold, cause destabilisation of the trajectories of the drops 40. In the very broken environment of the cavity 5 in which many elements such as the electrodes 30, 31 interfere with the air flow, the air velocity is preferably limited so as to avoid the creation of turbulence at uneven points. Beyond a certain threshold, this turbulence also destabilises drop trajectories which also degrades the print quality. The position of the air injector 9 as illustrated in FIG. 6B, distributes the air flow optimally in the cavity 5. Firstly, the air velocity remains supportable for the drops and approximately collinear with the jets 4 in the broken zone in the cavity in which the drops travel, and secondly the air velocity is greater between the jets and the internal wall 14 of the body 1 to provide a maximum air flow.

Figure 7B:
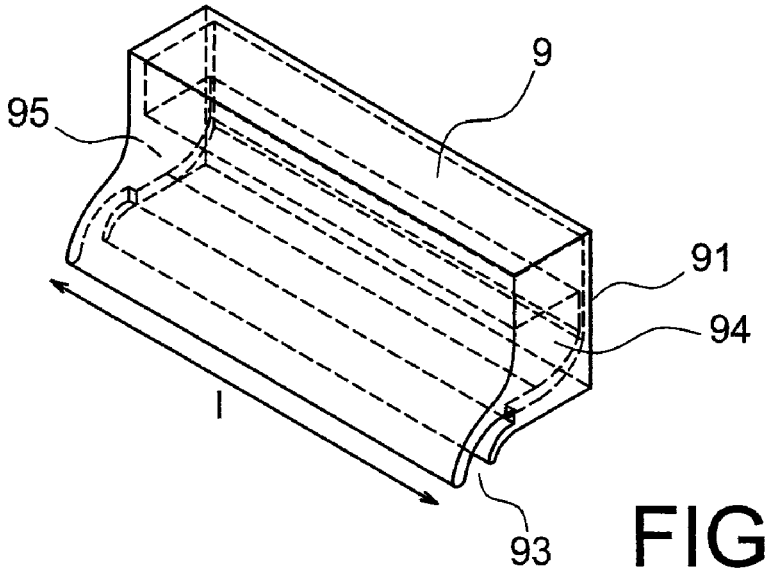

In this preferred embodiment of the blower device 8 in a modular head (T), composed of a plurality X of m-jet modules adjacent to each other on a support beam, this device 8 comprises the juxtaposition of air injectors 9*i* implanted in the modules (Mi) with one air injector 9 for each module (FIGS. 6B, 7B). Another interesting mode to be considered consists of implanting a single air injector for all X modules, the width l of this single injector being equal approximately to the large width of the print head.

Preferred Embodiment of the Air Injector:

The function of the air injector 9 is to distribute air supplied to it in the cavity 5 without turbulence, uniformly over its width l and along a direction parallel to the jets 4.

FIGS. 7A and 7B respectively show a preferred structure of the air injector 9 and an advantageous layout variant in the body 1. According to this advantageous layout variant, the injector 9 is an add-on part in a groove 13 machined in the body 1 of each print module (Mi). Its air supply takes place through the rear, in other words through an inlet duct 12 also formed through the body 1. In this case, air is advantageously distributed to the different modules (Mi) through the support beam (P) like ink used for printing.

Functionally, the air injector 9 according to FIG. 7A comprises a volume 90 in its upper part forming an air expansion and turbulence damping chamber. In this case, the volume of this chamber 90 is of the order of 0.7 $cm^3$ per injection module Mi, namely 22.4 $cm^3$ for a head (T) of X=32 modules. This chamber is supplied directly through the air duct 12 outputting the necessary flow for a given module (Mi) ejecting m jets or for the corresponding portion of cavity 5. This air inlet duct 12, a single duct in this case but that can be composed of multiple channels, typically has a diameter of 2 mm and injects highly turbulent air at high velocity into the chamber 90. The chamber opens onto a narrow vertical slit 91 (typically 300 μm wide) and long (typically 2 mm) compared with its width. The slit 91 is preferably made over the entire width l of the injector 9 (FIG. 7B). This slit 91 connects the upper chamber 90 to an outlet passage typically with a developed length of 8 mm (approximately equal to 4 times the height of the slit 91). The profile of the passage 92 is divergent and it is identical over the entire width l of the injector 9 (FIG. 7B). The volume of the chamber 90 and the high pressure loss created by the slit 91 are such that air expands; the air flows through the slit 91 uniformly over the width l of the slit. In this case, the air velocity in the slit 91 is of the order of 5 m/s for a typical flow at the outlet 93 of the order of 3 liters per minute for a module (Mi). The Reynolds number calculated over the section of the slit 91 in this case is equal to about 100, therefore the air flow arrives at the inlet to the passage 92 with an approximately laminar flow with minimum turbulence. In this case the outlet passage 92 is S-shaped so as to carry the air flow from the slit 91 to the injection zone in the cavity 5, orienting the output flow parallel to the jets 4. The passage 92 is divergent to reduce the air velocity and distribute the flow in the section of the cavity 5, while keeping the initial flow. The passage divergence half-angle θ is preferably less than 10°, so as to avoid separation of the air streams in the passage. This could create undesirable turbulence at the exit 93 from the passage 92. The shape of the different recesses forming the chamber 90, the slit 91 and the passage 92 from the injector 9 is advantageously intended such that there is no liquid retention zone. Thus, a liquid that somehow accidentally penetrates into the passage 92, the slit 91 or even the chamber 90, for example during cleaning of the cavity 5, will naturally be expelled outside the injector 9 by circulation of air brought in through the duct 12.

It is preferable to close the injector laterally by the end plates 94, 95 (FIG. 7B), so as to avoid air leaks between two adjacent modules (Mi/Mi+1) that would disorganise the injected air flow. Advantageously, the end plates 94, 95 of the injector do not completely close off the passage 92 in its part opening up into the cavity 5 (FIG. 7B); this minimises the flow disturbance created by the end plates 94, 95.

As indicated above, a preferred embodiment of the blower device 8 at a print module (Mi) consists of creating a rectangular section groove 13 in the body 1 and inserting the air injector 9 into it as shown in FIG. 7A. This embodiment is made possible through the use of the bottom wall of the groove 13 in the body 1 as the functional surface for the injector; this bottom wall closes off the expansion chamber 90 of the injector 9 at the back, so that the air inlet duct 12 can open into it directly. Furthermore, this bottom wall forms one face of the slit 91 that enables the pressure loss of the inlet air flow. The section of the inlet air flow is perfectly defined by the fact that the bottom wall of the groove 13 acts as a reference stop on which the back of the injector 9 applies pressure.

Figure 7C:
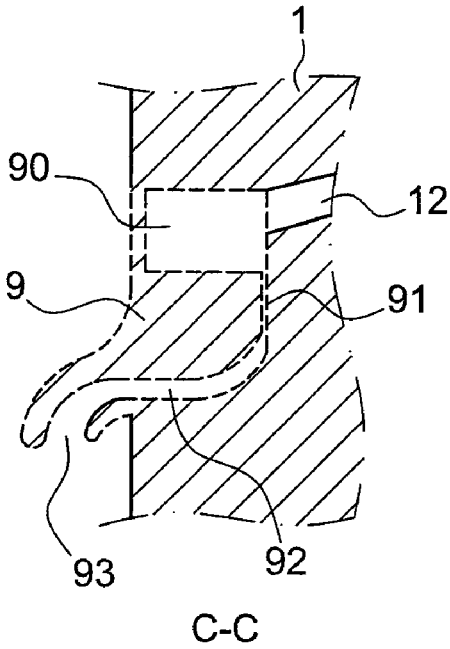

Another embodiment of the injector 9 shown in FIG. 7C is particularly interesting; this may be machined directly in the bulk of a single piece part 1, for example using wire cutting by spark machining. It is thus possible to keep the cutting tool perpendicular to the sides of the module (Mi), cutting being done along the trajectory shown in dashed lines in FIG. 7C that represents the profile of the section of the injector 9. With this embodiment, the shape of the section of the injector 9 may easily be adapted to optimise the determined air outlet function. According to this embodiment, the end plates 94, 95 may be added onto and fixed to the sides of the single-piece body 1, for example by any means known to those skilled in the art.

Preferred Dimension of the Air Flow:

The compensation of the air deficit related to aerodynamic effects and air suction through the gutter 10 preferably requires an inlet air flow of between 2 and 6 liters per minute and per module (or for 8 jets) (in other words a volume per minute equal to 150 to 450 times the volume of the cavity 5 for a module (Mi)) into the chamber(s) 90. This flow should preferably be increased by the flow necessary to create an output air flow intended to push back droplets generated by splatter under the head (T). Furthermore, the limiting air velocity at the exit from the injector 9 at which the inventor observed initial destabilisation of the trajectory of the drops 40, is about 0.7 m/s (namely $1/25^{th}$ times the velocity of the inkjet 4). This limiting value before destabilisation is observed at which the characteristic dimensions, the uneven environment of the cavity 5 and the characteristics of the air injection cause the occurrence of turbulence with a level such that the effect on the print quality becomes perceptible. For some types of pattern to be printed, the air velocity may be increased up to twice this limiting value, while keeping an acceptable print quality.

In practice, the inventor has observed that the flow should be as high as possible for a limiting air velocity before tolerable destabilisation (corresponding to 0.7 m/s for the curve shown in FIG. 8A) and at an arbitrary location at the outlet of the tip 93 from the air injector 9. The inventor has also observed that the jets 4 located close to the lateral position at which this velocity is maximum are the first to destabilise when the flow (or air velocity) is increased. Thus in practice, for a given air injector 9 configuration, the maximum possible flow will be higher if the air velocity profile is uniform over the entire width of the injector, but as long as the maximum tolerable value is not reached, the air velocity may have an arbitrary amplitude without disturbing the print quality.

FIG. 8A is a curve showing the transverse air velocity profile at the outlet of the tip 93 from the injector 9, for a flow of 2.5 l/min per module (Mi) and measured close to the middle of the injector. This FIG. 8A shows that the maximum of this transverse profile is offset slightly towards the jets 4, which tends to bring air at low velocity between the deflection electrodes 30.

Figure 8B:
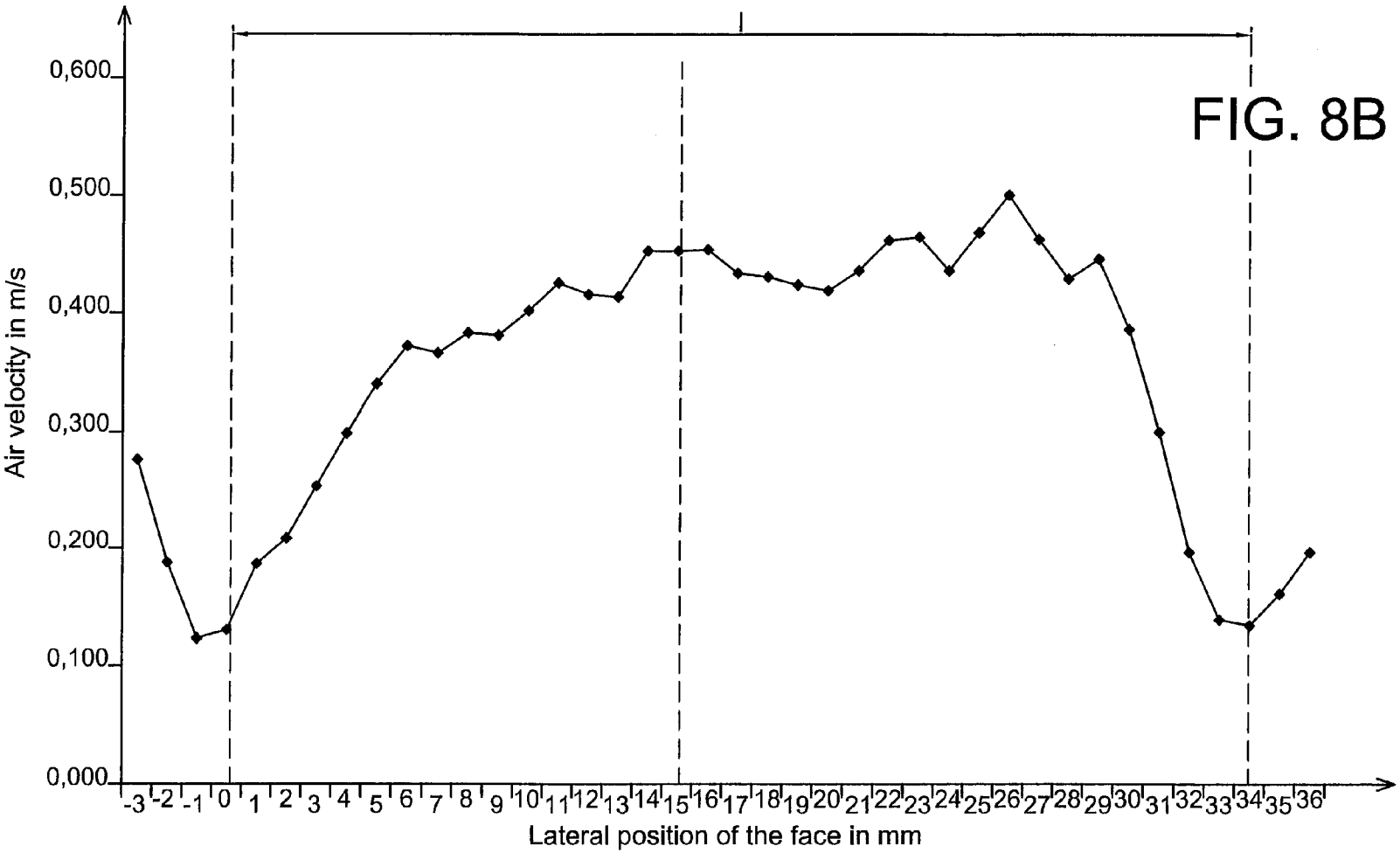

FIG. 8B shows the longitudinal profile of the air velocity measured at the outlet 93 from the injector 9, over a trajectory passing through the maximum of the transverse profile shown in dashed lines in FIG. 8A. The measurement is made on a print module (Mi) with width l inserted between two other adjacent modules (Mi+1 and Mi−1), slightly projecting on each side. This FIG. 8B shows that the longitudinal profile is approximately uniform over the central ⅔ of the injector 9 and the air velocity reductions observed on the edges correspond to the flow being sheltered by the side plates 94,95 of the injector 9. As explained above, these velocity drops have no incidence on operation of the system. The low asymmetry between the left and right parts of the profile are explained by the position of the air inlet orifice 12 as it enters the expansion chamber 90 of the injector 9, offset by construction.

Preferred Air Supply Device on the Input Side of Air Injectors 9:

Each air injector 9 generates an air flow independently. The required flow uniformity at each print module (Mi) in this case is extended to the head (T). To achieve this, the air supply characteristics to each injector are identical. The main air flow is unique for a given head (T), the distribution to injectors 9 advantageously being made with balanced pressure losses. In the preferred embodiment, the tolerable flow unbalance between modules is of the order of 0.1 l/min. Therefore, the flow adjustment may be made at the source, globally for a module support beam (Mi). The input side air treatment preferably provides perfectly dry air to replace air saturated with solvent vapour in the cavity 5 and to dry the electrodes 30,31 and the walls of the cavity. The air is also preferably filtered to prevent pollution of the internal elements 10, 20, 30,31 in the cavity and also ink 40 that returns to the ink circuit because a large quantity of air is drawn in by the gutters 10 at the same time as the ink not used for printing that returns to the ink circuit.

FIG. 9 shows a diagram of the air supply device for a printer with at least one wide format print head (T).

The blower compressor 80 supplies de-oiled air to an air dryer 81 followed by a particle filter 82. Air at the exit from the filter 82 has the required quality to supply injectors 9 to each module (Mi) with a general flow adjustment for each print head (T). This is followed by the distributor 83 with balanced pressure losses, and for each module (Mi), the air injector 9 comprises an expansion and turbulence damping chamber 90, a slit 91 and the divergent passage 92 leading to the outlet 93.

FIGS. 10A to 10D illustrate the means according to the invention used to extract droplets generated by splatter due to the impact of the drops 40 onto the support (S) from below the wide format print head (T).

The air flow output from the head (T) through the outlet slit 6 prevents most of the droplets generated by splatter from returning inside the head (T), in other words in the cavity 5 of each module. However, since the air flow outlet from the head must be limited for the reasons mentioned above, the output air flow may not be sufficiently effective in some cases in which the dirt appears on the internal edges of the slit.

The air stream output from the head strikes the moving support to be printed (S) and creates turbulence (represented by the spiral lines shown in FIG. 10A) that combine with air displaced by the support (S). The air moves under the head (T) from electrode blocks 3 to the support beam (P). The consequence is that the disturbance of the air under the head (T) causes redeposition of the droplets projecting them onto the nearby surfaces and rather on the output side of the impact point of the drops 40, namely below the back 1,P of the head and on the support to be printed, as shown by the arrows shown in dashed lines in FIG. 10A. Note that if the support velocity is low, the air flow output perpendicularly from the head is preponderant and splatter can be distributed in all directions, including on the input side of the head. Thus, firstly the print quality is degraded, and secondly it becomes necessary to regularly clean the bottom 1, P of the head (T) and possibly the inside of the outlet slit, which limits the availability of the wide format printer. The inventor had the idea of extracting the droplets from the bottom 1, P of the head (T) before they are redeposited, to overcome these disadvantages.

Two methods are used for this purpose.

The first method consists of blowing air through a blower nozzle (BS) between the head (T) and the support (S) along a direction parallel to the support and in the direction of its displacement (from the input side to the output side), as shown in FIG. 10B. This air flow is combined with the air flow perpendicular to the support through the outlet slit 6 of the head (T) to create a laminar air current that forces the turbulence and droplets to move in the downstream direction, outside the print zone. The droplets thus expelled into the environment around the printer are retrieved by the general air extraction system of the wide format printer.

The second method shown diagrammatically in FIG. 10C consists of placing suction openings (Basp) between the head (T) and the support (S) on the downstream side of the outlet slit 6 for the drops 40. The suction generates an air flow parallel to the support that, combined with the air stream output perpendicular to the slit 6, creates an air current that causes turbulence and droplets in the suction openings (Basp).

Figure 10D:
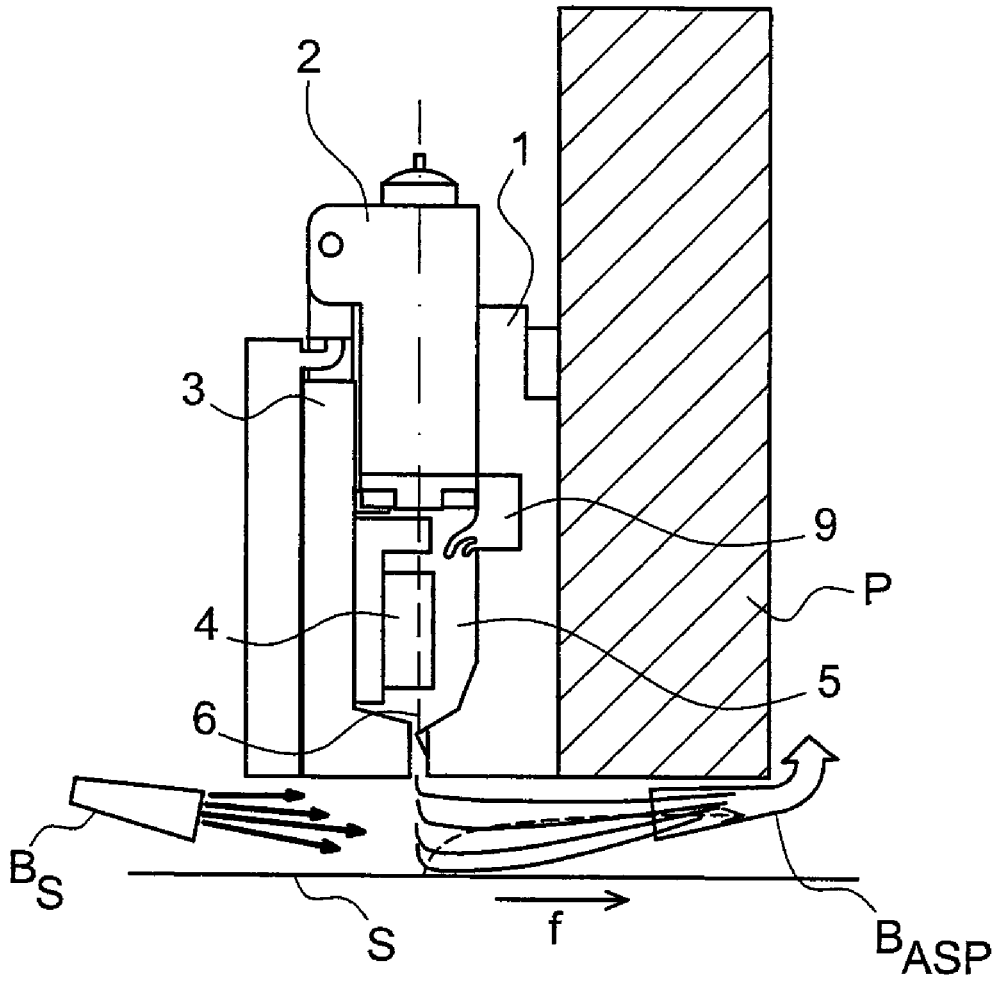

Obviously, the two methods can be combined as shown diagrammatically in FIG. 10D. Those skilled in the art will take care to create a specific adjustment for the blowing or suction intensity so that it is effective against turbulence and transport of droplets, without destabilising the end of the trajectory of the print drops 40. This adjustment depends on the flow and velocity of air output from the head (T).

The different aspects of the invention that have just been described apply to (A, B, C):

A) closing of the ends of the print head (T) by end plates 70, 71; closing of the orifices that enable a point or local air inlet in the cavity 5 of the head, particularly the lateral ends 94, 95 of the cavity 5.

B) injection of an air flow passing through the cavity 5 from generation of the inkjet 4 to the exit of the drops 40, while remaining homogeneous over the width of the head (T) and circulating approximately parallel to the jets 4 to prevent the transverse components from disturbing the trajectory of the drops 40 and degrading the printout.

This air flow has the following advantageous characteristics:

- it may be dry, and possibly hot, to dry the inside of the head,
- it may be clean, to prevent pollution of the cavity 5 and the ink 4, for example by oil and particles,
- it is preferably injected below the sensitive zone in which the drops form, to avoid disturbing the charge on the drops 40,
- it is preferably injected above the deflection plates 31, such that dry air dries them while circulating,
- its flow is preferably greater than 50 times the volume of the cavity per minute to expel moist air and/or solvent vapours outside the head,
- its flow is sufficient to cancel out the aerodynamic effects between jets 4 by neutralising the pressure pressure created inside the cavity 5 of the head. This flow includes air entrained by the drops towards the outside of the head, the air drawn in through the gutters 10 and the additional air creating an output flow through the slits 6 distributed along the head (T). In the preferred embodiment of the invention, this flow is between 50 and 500 times the cavity volume per minute,
- its air velocity in the cavity 5 is lower than the level at which turbulence becomes sufficiently high to destabilise the trajectory of the drops 40 and degrade printing. This air velocity in the cavity 5 is advantageous and must enable it to accept dispersions, fluctuations and local level of the air flow generation. In the preferred embodiment of the invention, this limiting velocity before the drop trajectories are destabilised is between 1/10 and 1/50 of the velocity of the jet 4,
- its air velocity in the outlet slit 6 of the head (T) is sufficient to oppose the kinetic, aerodynamic and electrostatic forces that carry droplets output from splatter to the inside 5 of the head. In the preferred embodiment, the velocity is between 0.05 and 0.5 meters per second.

According to one example, this air flow in the wide format print head (T) may be generated by a device comprising the following preferred means:

- a blower compressor 80 generating the necessary air flow (up to 500 times the volume of the cavities 5 per minute, namely 6.5 l/min/module) and capable of supplying one or several print heads (T),
- an air dryer 81 on the downstream side of the compressor 80 so as to obtain a low hygrometry appropriate for use, possibly adjustable as a function of the conditions occurring within the cavity 5,
- a filter 82, on the downstream side of the compressor 80 used to purify air,
- a global air flow adjustment device for a given print head (T),
- a distributor 83 distributing air to each module (Mi) in the head with a flow for which the unbalance between modules is less than 0.1 l/min,
- an air injector 9 located in each module (Mi) and with the same width as the module. Putting modules (Mi) adjacent to each other within the framework of a modular wide format ink jet printer, provides a means of building a blower device 8 distributed homogeneously over the width of the head (T).

The air injector 9 is preferably composed of the following means:

- an expansion and turbulence damping chamber 90, for which one of the dimensions is equal to the width of the injector 9 and for which the unit volume is typically of the order of 0.7 $cm^3$,
- a slit 91 opens up with a pressure loss function, in which the chamber 90 and the slit 91 is formed over the entire width of the chamber, and its cross section has a length/thickness ratio (thickness corresponding to the cross-section of the slit passage) of the order of 7. The width/thickness ratio is of the order of 17,
- a divergent air diffusion passage 92 for which the divergence half-angle θ is less than 10°, for which the length is typically four times greater than the slit 91; the entry into the passage corresponding to the outlet from the slit 91 and the outlet 93 opens up into the cavity 5 of the head (T),
- two end plates 94,95 laterally closing the chamber 90, the slit 91 and a part of the passage 92.

C) the displacement of the splatter droplets present between the print head (T) and the printed support (S), by the creation of an air current under the head, parallel to the movement of the support, and in the direction of this movement f. This air current may advantageously be produced by:

- blowing from the nozzle(s) (Bs) located on the upstream side of the head (T),
- suction through the opening(s) located on the downstream side of the head (T),
- a combination of blowing on the upstream side and suction on the downstream side.

Although the invention has been described with reference to a wide format print head according to the deviated continuous jet technology, it is equally applicable to an inkjet technology based on binary continuous jet or drop on demand. Thus while in the deviated jet technology only part of the ejected ink exits from the outlet orifice according to the invention and is used to print the moving support, in the drop on demand technology, all ejected ink exits from the orifice according to the invention and is used to print the moving support.

The invention can also be applied to a wide format print head moved over a support either perpendicular to the direction of the strip or parallel to it.

The invention can also be applied to so-called scanning heads

Similarly, the invention can be applied to wide format heads made in a single piece, in other words in this case, the value X according to the invention is equal to 1 and a given wide format head comprises a single print device and a single injector.

The air velocity at the injector outlet is advantageously less than $1/10^{th}$ of the velocity of the jets or the drops.

The air velocity injected into the print device (Mi) is advantageously equal to at least $1/25^{th}$ of the ink ejection velocity.

The invention claimed is:

1. Wide format multi-jet print head (T), wider than 1 meter, composed of several X inkjet print devices (Mi) intended to print on a moving support (S) in which:

- each device comprises:
  - a body intended to extend along an axis (A-A') transverse to the direction of motion (f) of the support,
  - an ink ejector fixed to the body and adapted to eject ink along an ejection plane (E) parallel to the axis (A-A'),
  - at least one part defining an output orifice (6) through which at least part of the ejected ink (40) passes to print the moving support, a cavity delimited at least by the body, the ejector and the part(s) defining the output orifice, an air injector adapted to blow air with a flow approximately parallel to the ink ejection plane (E) passing through the cavity, from a zone below the ejector as far as the output orifice;

the devices are in the form of adjacent modules (Mi) along the same transverse axis (A-A') and each module producing several m jets and comprising a block of electrodes, in which a single injector is common to all modules (M1-Mx), the injected air flow being uniform over the width of the head (T).

2. Wide format multi jet print head (T), wider than 1 meter, composed of several X inkjet print devices (Mi) intended to print a moving support (S) in which:

each device comprises:

a body intended to extend along an axis (A-A') transverse to the direction of motion (f) of the support, an ink ejector fixed to the body and adapted to eject ink along an ejection plane (E) parallel to the axis (A-A'), at least one part defining an output orifice through which at least part of the ejected ink passes to print the moving support, a cavity delimited by at least the body, the ejector and the part(s) defining the output orifice, an air injector adapted to blow air with a flow approximately parallel to the ejection plane (E) of the ink passing through the cavity, from a zone below the ejector as far as the output orifice;

the print devices are in the form of adjacent modules (Mi) along the same transverse axis (A-A'), each module (Mi) producing several m jets and comprising a block of electrodes and an air injector, the injected air flow being uniform over the width of the head (T), namely the air flow difference Δ between two injectors is less than or equal to 0.1 l/min.

3. Wide format multi jet print head (T) according to claim 2, in which the air inlet is common to X air injectors.

4. Wide format multi jet print head (T) according to claim 1 or claim 2, in which an end plate is arranged at transverse ends of the head (T) so as to transversally close the cavities of the two devices (M1, Mx) the furthest away from each other.

5. Wide format multi jet print head (T) according to claim 1 or claim 2, in which, for each print device, two parts define the output orifice forming a slit, one being formed by part of the body and the other being formed by a part forming a toe of the block of electrodes, the block of electrodes having an operating position such that at least one input side part is located in the ejection plane (E) and such that the spacing between the output side toe and the body defines the width of the output slit; the volume delimited by the body, the ejector and the block of electrodes in operating position defining the cavity opening up on the output slit.

6. Wide format multi-jet print head (T) according to claim 1 or claim 2, in which, for each print device, the block of electrodes is pivoting about the ink ejector between its operating position and an extreme raised position to enable maintenance of the ink ejector and/or the block of electrodes and/or the air injector.

7. Wide format multi jet print head (T) according to claim 1 or claim 2, in which, for each print device, the ink ejector is adapted to eject ink in the form of continuous jets, the break point of each jet being placed close to the middle of charge electrodes of the electrodes block and in which the air injector is positioned so as to blow air below the charge electrodes and above the deflection electrodes of the block.

8. Wide format multi jet print head (T) according to claim 1 or claim 2, in which, for each print device, the air injector is positioned so as to blow air between the ejection plane (E) of the ink jets and the body.

9. Wide format multi jet print head (T) according to claim 1 or claim 2, in which, for each print device, the air velocity at the injector outlet is less than $1/10^{th}$ of the velocity of the ink jets or the ink drops.

10. Wide format multi-jet print head (T) according to claim 1 or claim 2, in which for each print device, the blown air is dry air.

11. Wide format multi jet print head (T) according to claim 1 or claim 2, in which for each print device, the blown air is filtered air.

12. Wide format multi jet print head (T) according to claim 1 or claim 2, in which for each print device, the air injector is fixed to the body.

13. Wide format multi jet print head (T) according to claim 12, in which, for each print device, the air injector is inserted into a groove formed in the body.

14. Wide format multi jet print head (T) according to claim 1 or claim 2, in which for each print device, the air injector forms an integral part of the body.

15. Wide format multi jet print head (T) according to claim 1 or claim 2, in which, for each print device, the air flow from the air injector is between 50 and 500 times the cavity volume per minute.

16. Wide format multi jet print head (T) according to claim 1 or claim 2, in which, for each print device, the air velocity injected is equal to at least $1/25^{th}$ of the ink ejection velocity.

17. Wide format multi-jet print head (T) according to claim 1 or claim 2, in which, for each print device, the air injector comprises an inner chamber adapted to be directly connected to an air inlet duct and to expand air and to damp turbulence of incoming air.

18. Wide format multi-jet print head (T) according to 17, in which the air injector comprises an inner channel on the output side of the inner chamber, forming a passage a profile identical over its entire length but diverging in cross section of the injector, as far as the injector output in the cavity.

19. Wide format multi jet print head (T) according to claim 18, in which the divergence half-angle θ passage is less than 10°.

20. Wide format multi-jet print head (T) according to claim 18, in which the air injector comprises a slit connecting the inner chamber to the passage and making the air originating from the chamber approximately laminar.

21. Wide format multi-jet print head (T) according to claim 20, in which two end plates laterally closed the chamber, the slit and a part of the passage of the injector.

* * * * *